US006322422B1

(12) United States Patent
Satou

(10) Patent No.: US 6,322,422 B1
(45) Date of Patent: Nov. 27, 2001

(54) APPARATUS FOR ACCURATELY MEASURING LOCAL THICKNESS OF INSULATING LAYER ON SEMICONDUCTOR WAFER DURING POLISHING AND POLISHING SYSTEM USING THE SAME

(75) Inventor: Yuuichi Satou, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/232,928

(22) Filed: Jan. 19, 1999

(51) Int. Cl.[7] ..... B24B 49/00

(52) U.S. Cl. ..... 451/8; 451/283; 451/285; 451/385

(58) Field of Search ..... 451/8, 283, 285, 451/385, 908

(56) References Cited

U.S. PATENT DOCUMENTS 5,492,594 * 2/1996 Burke et al. .
5,562,529 * 10/1996 Kishii et al. .
5,851,135 * 12/1998 Sandhu et al. .
5,916,009 * 6/1999 Izumi et al. .
5,961,369 * 10/1999 Bartels et al. .
6,007,405 * 12/1999 Mei .

FOREIGN PATENT DOCUMENTS 58-115618 7/1983 (JP) .
1-207929 8/1989 (JP) .
1-306073 12/1989 (JP) .
4-357851 12/1992 (JP) .
9-134904 5/1997 (JP) .
10-233-421 9/1998 (JP) .

* cited by examiner

*Primary Examiner*—Joseph J. Hail, III
*Assistant Examiner*—Willie Berry, Jr.
(74) *Attorney, Agent, or Firm*—Laff, Whitesel & Saret Ltd; J. Warren Whitesel

(57) ABSTRACT

A polishing system has a polishing pad, a wafer retainer for pressing an insulating layer formed on a semiconductor wafer against polishing slurry spread over a polishing pad and a measuring apparatus for measuring the thickness of different portions of the insulating layer, and the measuring apparatus has measuring electrodes embedded in the polishing pad, a first calibration electrode also embedded in the polishing pad and a second calibration electrode embedded into the lower surface of the wafer retainer, wherein the first calibration electrode and the measuring electrodes are opposed to the second calibration electrode and an electrode formed in a dicing area of the semiconductor wafer during the polishing so that the measuring apparatus determines the thickness at the different portions on the basis of a first capacitance between the first calibration electrode and the second calibration electrode and a second capacitance between the measuring electrodes and the electrode in the dicing area.

23 Claims, 4 Drawing Sheets

APPARATUS FOR ACCURATELY MEASURING LOCAL THICKNESS OF INSULATING LAYER ON SEMICONDUCTOR WAFER DURING POLISHING AND POLISHING SYSTEM USING THE SAME

FIELD OF THE INVENTION

This invention relates to a measuring technology and, more particularly, to an apparatus for measuring local thickness of an insulating layer on a semiconductor wafer during a polishing and a polishing system using it.

DESCRIPTION OF THE RELATED ART

While a manufacturer is fabricating an integrated circuit on a semiconductor wafer, a semiconductor layer and an insulating layer are repeatedly deposited over the semiconductor wafer, and are patterned through a photolithography. The patterned layers deteriorate the step coverage, and the lower insulating layer is subjected to a polishing before deposition of a semiconductor layer. If the lower insulating layer is polished too much, the insulating layer can not offer good electrical isolation, and the detection of remaining thickness is important.

A typical example of the apparatus for measuring the thickness of the remaining insulating layer is disclosed in Japanese Patent Publication of Unexamined Application Ser. No. 4-357851, and FIG. 1 illustrates the prior art measuring apparatus.

The prior art measuring apparatus is used for a semiconductor wafer 1. An insulating layer 2 has been already deposited on the semiconductor wafer 1, and is now being polished on a polishing pad 3. Polishing slurry 4 is supplied onto the polishing pad 3, and the polishing pad 3 is rotating with respect to the insulating layer 2.

The prior art measuring apparatus comprises a measuring electrode 5, a protective electrode 6 and an insulating layer 6*a*, and the measuring electrode and the protective electrode 6 are embedded in the polishing pad 3. The measuring electrode 5 and the protective electrode 6 are exposed to the polishing slurry 4. The measuring electrode 5 is spaced from the protective electrode 6, and the insulating layer 6*a* electrically isolates the measuring electrode 5 from the protective electrode 6.

The prior art measuring apparatus further comprises a measuring section 7 and an amplifier 8. The measuring section 7 is directly connected to the measuring electrode 5 and to the non-inverted input node of the amplifier 8. The output node of the amplifier 8 is connected to the protective electrode 6 and the inverted input node. A parasitic capacitor 9 is connected to the back surface of the semiconductor wafer 1. The measuring section 7 supplies an alternating current signal DT1 to the measuring electrode 5 and the non-inverted input node. The amplifier 8 shifts the phase of the alternating current signal DT1 by 180 degrees, and produces an inverted alternating current signal CDT1.

While the insulating layer 2 is being polished, the measuring section 7 supplies the alternating current signal DT1 to the measuring electrode 5, and the inverted alternating current signal CDT1 is supplied to the protective electrode 6 for bootstrapping. The alternating current signal DT1 varies the amplitude in proportion to the thickness of the insulating layer 2, and the measuring section 7 produces an output signal OUT1 indicative of the thickness of the remaining insulating layer 2.

The prior art measuring apparatus merely measures an average thickness. The semiconductor wafer 1 is getting large, and the manufacturer hardly polishes the insulating layer 2 uniformly. This means that the insulating layer 2 is locally different in thickness from the average thickness. The prior art measuring apparatus can not measure the locally different thickness. This is the first problem inherent in the prior art measuring apparatus.

The second problem is undesirable damage to the circuit components fabricated on the semiconductor wafer 1. When the alternating current signal DT1 is applied to the measuring electrode 5, the electric field extends over the semiconductor wafer 1. The electric field is liable to damage the circuit components.

SUMMARY OF THE INVENTION

It is therefore an important object of the present invention to provide a measuring apparatus, which can measure the thickness of an arbitrary portion of an insulating layer without damages to circuit components.

It is also an important object of the present invention to provide a polishing system, which realizes an insulating layer with completely uniform thickness.

In accordance with one aspect of the present invention, there is provided an apparatus for measuring a thickness of an insulating layer having a first surface held in contact with a first electrode means and a second surface opposite to the first surface and held in contact with a non-conductive liquid spread over a moving member, and the apparatus comprises a second electrode means stationary with respect to the moving member, changing a relative position with respect to the first electrode means and a first distance to the first electrode means together with the moving member and forming a first capacitor together with first electrode means, the insulating layer and the non-conductive liquid, a third electrode means stationary with respect to the insulating layer and with respect to the first electrode means, a fourth electrode means stationary with respect to the moving member, changing a second distance to the third electrode means and forming a second capacitor together with the third electrode means and the non-conductive liquid, a source of electric power connected between the first and third electrode means and the second and fourth electrode means, a measuring equipment connected to the second electrode and the fourth electrode for measuring a first capacitance between the first electrode means and the second electrode means and a second capacitance between the third electrode means and the fourth electrode means and a calculating means connected to the measuring equipment for determining a thickness of the insulating layer on the basis of the first capacitance and the second capacitance.

In accordance with another aspect of the present invention, there is provided a polishing system for polishing an insulating layer formed on a semiconductor wafer, and the polishing system comprises a measuring means for measuring a thickness of more than one portion of the insulating layer, a polishing pad for polishing a surface of the insulating layer, a feeding means for supplying non-conductive polishing slurry between the polishing pad and the surface of the insulating layer, a pressurizing means exerting variable force on a plurality of portions of the semiconductor wafer for pressing the insulating layer against the polishing pad and a controlling means connected to the measuring means and the pressurizing means for instructing the pressurizing means to vary the variable force at the plurality of portions depending upon the thickness of the more than one portion of the insulating layer.

BRIEF DESCRIPTION OF THE DRAWINGS

The features and advantages of the measuring apparatus will be more clearly understood from the following description taken in conjunction with the accompanying drawings in which.

DESCRIPTION OF THE PREFERRED EMBODIMENT

Figure 1:
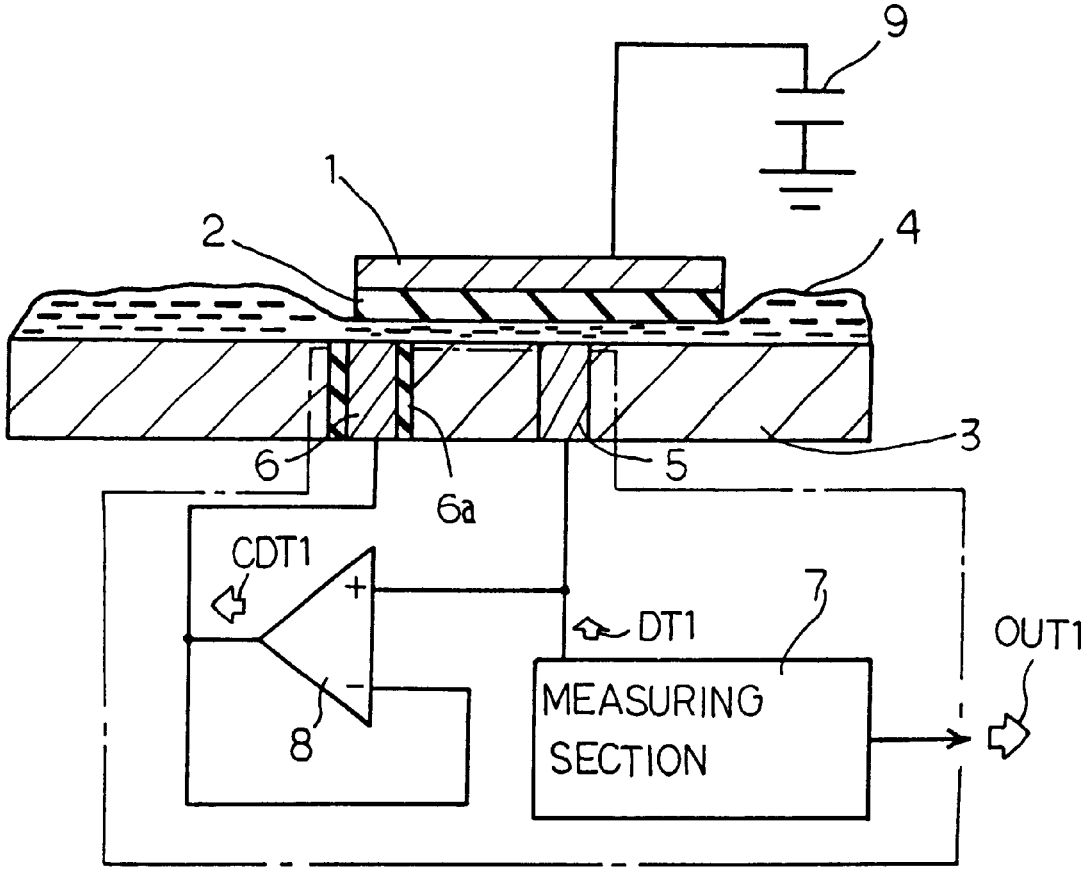
Fig. 1 PRIOR ART
FIG. 1 is a schematic cross sectional view showing the prior art measuring apparatus.
Figure 2:
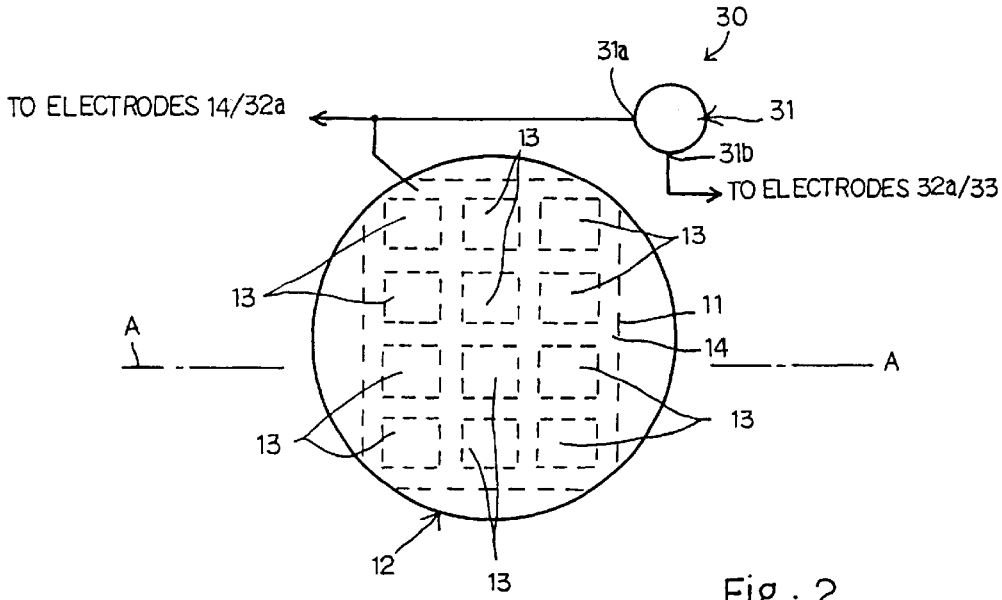
FIG. 2 is a plane view showing a semiconductor wafer to be polished.

Referring to FIG. 2 of the drawings, a dicing area 11 is formed in a major surface of a semiconductor wafer 12 like a lattice, and an integrated circuit is to be fabricated in device areas 13. The semiconductor wafer 12 will be broken into semiconductor chips along the lattice-like dicing area 11. Conductive material is deposited on the dicing area 1, and forms an electrode 14.

Figure 3:
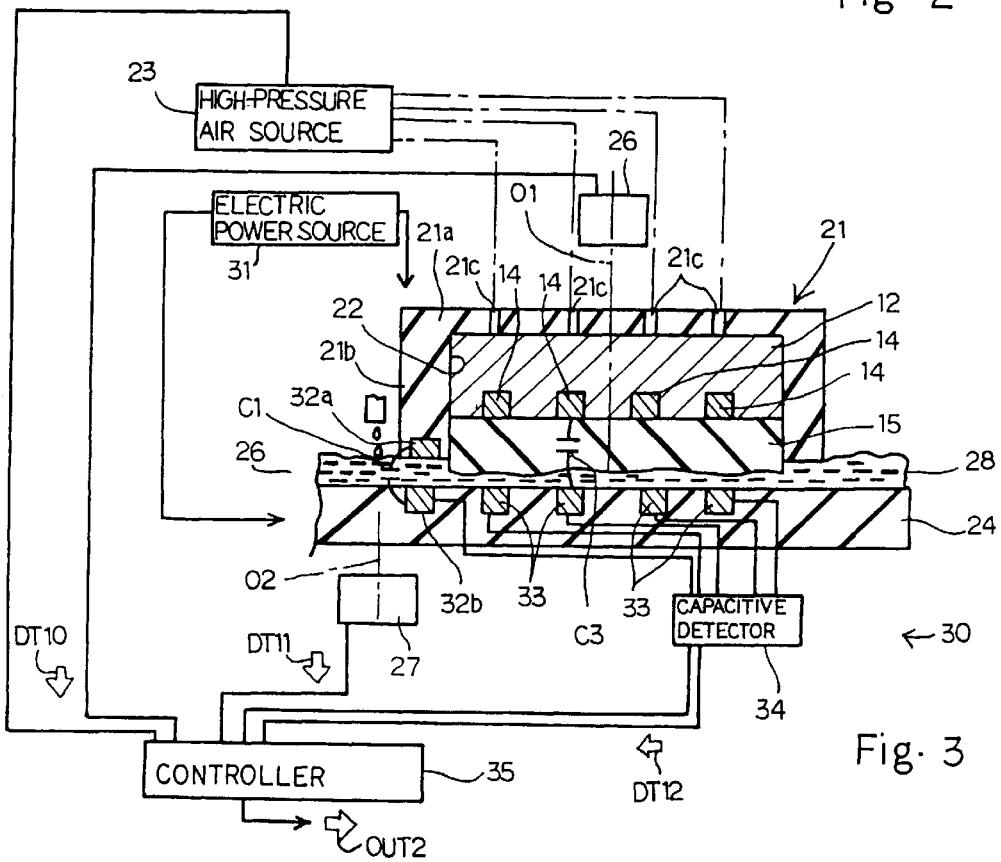
FIG. 3 is a schematic cross sectional view showing the semiconductor wafer held by a retainer.

Although circuit components such as, for example, field effect transistors have been already fabricated on the device areas 13, the circuit components are too small to be shown. The major surface of the semiconductor wafer is covered with insulating material, and the insulating material forms an inter-level insulating layer 15 (see FIG. 3). The inter-level insulating layer 15 is to be polished. FIG. 3 shows the cross section of the semiconductor wafer 11 along line A—A.

The semiconductor wafer 12 is held by a wafer retainer 21 as shown in FIG. 3. In detail, a recess 22 is formed in the wafer retainer 21, and the wafer retainer 21 is broken down into a bottom wall portion 21*a* and a side wall portion 21*b*. The wafer retainer 21 accommodates the semiconductor wafer 12 in the recess 22. Plural through-holes 21*c* are formed in the bottom wall portion 21*a*, and connect a high-pressure air source 23 to the recess 22. The high-pressure air presses the inter-level insulating layer 15 against a polishing pad 24. If the high-pressure air source 23 selectively supplies the high-pressure air to the through holes 21*c*, the force is locally exerted on the semiconductor wafer 12, and a part of the inter-level insulating layer 15 is strongly pressed against the polishing pad 24.

The wafer retainer 21 is connected to a driving mechanism (not shown), and is driven for rotation around an axis O1. An angle measuring equipment 26 is connected to the axis O1, and measures the rotating angle of the wafer retainer 21. The polishing pad 24 is spread over a turn table (not shown), and the turn table is drive for rotation around an axis Q2 by a driving mechanism (not shown). An angle measuring equipment 27 is connected to the axis O2, and detects the rotating angle of the polishing pad 24. Polishing slurry 28 is supplied onto the polishing pad 24, and is non-conductive. The axis O2 is offset from the axis O1, and the inter-level insulating layer 15 is polished through two kinds of rotary motion.

A measuring apparatus 30 embodying the present invention is used for the insulating layer 15 during the polishing. The measuring apparatus 30 comprises the angular measuring equipments 26/27, a source of electric power 31, a pair of calibration electrodes 32*a*/32*b* and plural measuring electrodes 33. The source of electric power 31 has a first electrode 31*a* and a second electrode 31*b*, and the first electrode 31*a* is opposite in polarity to the second electrode 31*b*. The first electrode 31*a* is connected to the electrode 14 and the calibration electrode 32*a*, and the second electrode 31*b* is connected to the other calibration electrode 32*b* and the measuring electrodes 33.

The calibration electrode 32*a* is embedded in the side wall portion 21*b* of the retainer 21, and the other calibration electrode 32*b* is embedded in the polishing pad 24. The calibration electrode 32*a* is opposed to the other calibration electrode 32*b* at a certain timing during the two kinds of rotary motion, and the calibration electrodes 32*a*/32*b* form a capacitor C1 together with the polishing slurry 28 therebetween.

Figure 4:
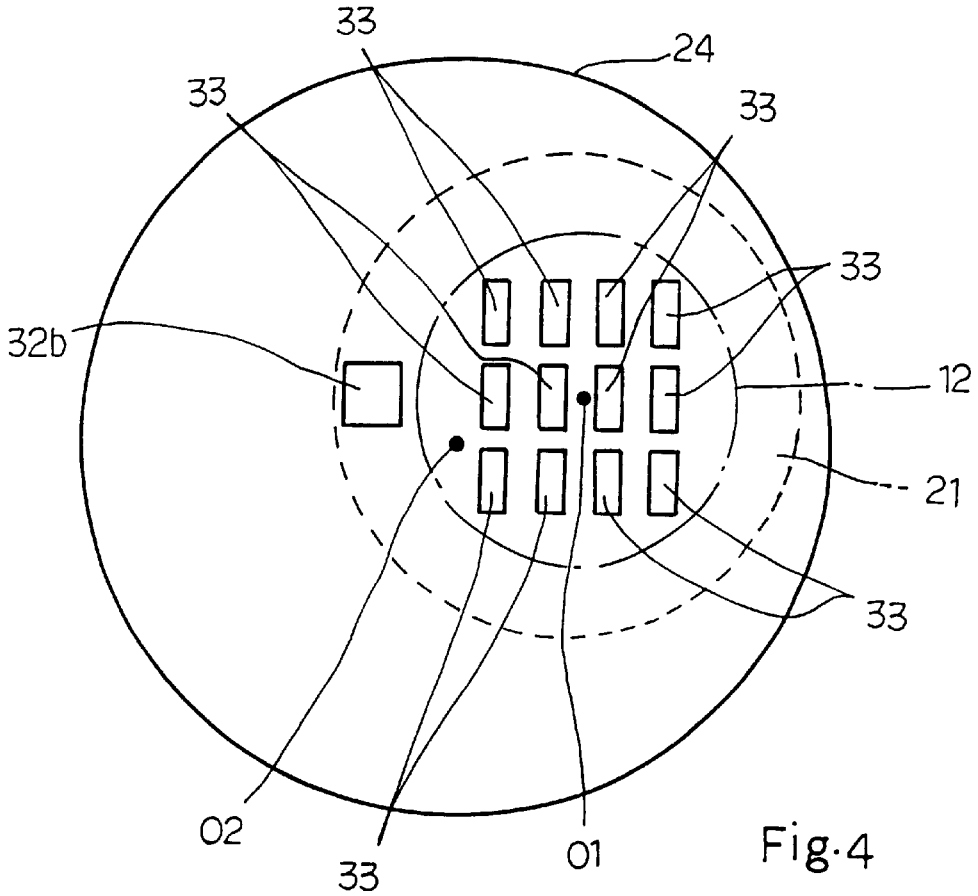
FIG. 4 is a plane view showing the arrangement of measuring electrodes and a calibration electrode.

On the other hand, the measuring electrodes 33 are also embedded in the polishing pad 24, and are arranged in matrix. The measuring electrodes 33 are opposed to the crossing portions of the lattice-like electrode 14 at the certain timing during the two kinds of rotary motion. The measuring electrode 33 and the crossing portion form capacitors C3 together with the non-conductive polishing slurry 28 and the inter-level insulating layer 15. FIG. 4 illustrates the calibration electrode 32*b* and the measuring electrodes 33 embedded in the polishing pad 24.

Turing back to FIG. 3 of the drawings, the measuring apparatus 30 further comprises a capacitive detector 34 and a controller 35. The capacitive detector 34 are connected through parallel signal lines to the calibration electrode 32*b* and the measuring electrodes 33, and measures the capacitance of the capacitor C1 and the capacitance of each of the capacitors C3. The signal lines are sequentially connected to the capacitive detector 34, and the capacitive detector 34 successively measures the capacitance of the capacitor C1 and the capacitance of each capacitor C3. The controller 35 is connected to the angular measuring equipments 26/27 and the capacitive detector 34, and produces an output signal indicative of the thickness of the inter-level insulating layer 15 as described hereinbelow.

After deposition of the inter-level insulating layer 15 on the semiconductor wafer 12, the manufacturer attaches the semiconductor wafer 12 to the retainer 21, and the inter-level insulating layer 15 is pressed against the polishing pad 24. The polishing slurry 28 is supplied onto the polishing pad 24, and the driving mechanisms (not shown) rotate the turn table (not shown) and the retainer 21. The polishing pad 24 and the semiconductor wafer 12 are rotated around the axes O1/O2 in the same direction, i.e., clockwise direction or counter-clockwise direction, and the inter-level insulating layer 15 is polished through the two kinds of rotary motion.

The angular measuring equipment 26 produces a detecting signal DT10 indicative of the angular position of the retainer 21, and the other angular measuring equipment 27 produces another detecting signal DT11 indicative of the angular position of the polishing pad 24. The detecting signals DT10 and DT11 are supplied to the controller 35, and the controller checks the angular positions to see whether or not the calibration electrode 32*a* is just opposed to the other calibration electrode 32*b*.

When controller 35 decides that the calibration electrodes 32*a* is opposed to the calibration electrode 32*b*, the measuring electrodes 33 are respectively opposed to the crossing portions of the lattice-like electrode 14, and the controller 35 instructs the capacitive detector 34 to sequentially measure the capacitance C1/C3. The capacitive detector 34 sequentially selects the signal lines, and measures the capacitance of the capacitor C1 and the capacitance of the capacitor C3 between each measuring electrode 33 and the associated crossing portion. The capacitance C1/C3 is successively reported to the controller 35 through a detecting signal DT12, and the controller 35 stores the values of the detecting signal DT12 in an internal memory (not shown).

Figure 5:
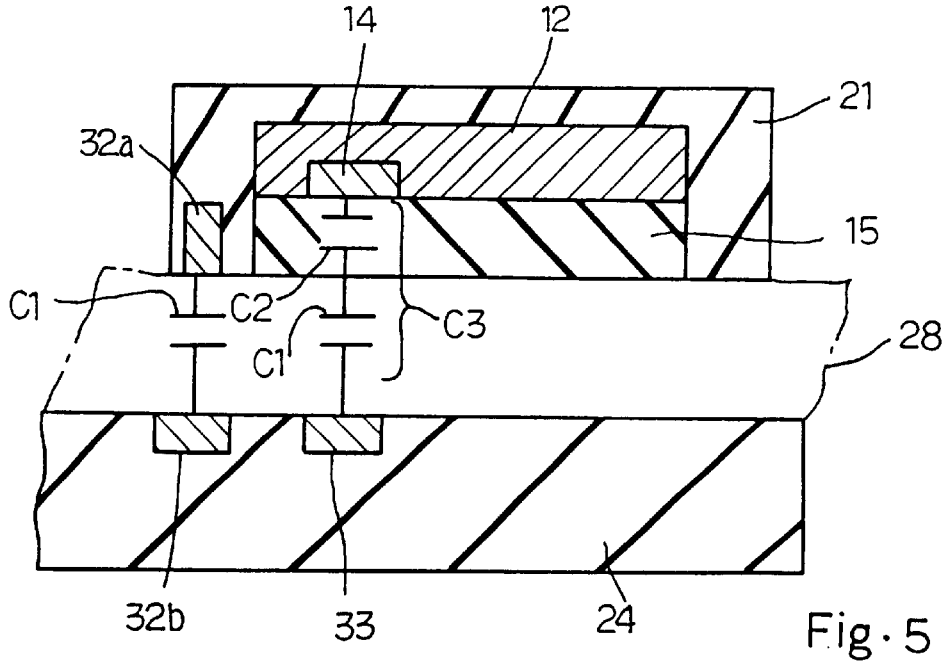
FIG. 5 is a cross sectional view showing a polishing operation on an interlevel insulating layer locally pressed against a polishing pad.
Figure 6:
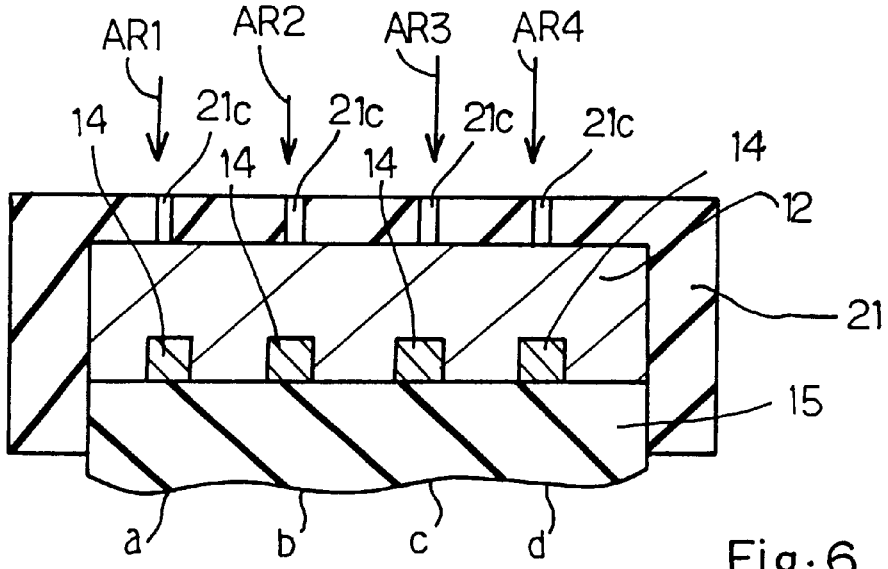
FIG. 6 is a plane view showing portions of the inter-level insulating layer to be polished.

As shown in FIG. 5, the capacitor C3 is equivalent to a combination of the capacitor C1 and a capacitor C2. The non-conductive polishing slurry 28 serves as the dielectric layer of the capacitor C1, and the inter-level insulating layer 15 serves as a dielectric layer of the capacitor C2. For this reason, the controller 35 subtracts the capacitance of the capacitor C1 from the capacitance of each capacitor C3, and determines the capacitance of the capacitor C2. The controller 35 sequentially calculates the capacitance of the capacitors C2 at the measuring electrodes 33, and determines the dispersion of thickness for the inter-level insulating layer 15.

If the controller 35 reports that portions a/b/c/d of the inter-level insulating layer 15 are difference in thickness as c=d>a>b, the controller 35 instructs the high-pressure air source 23 to regulate the air pressure at the through-holes 21*a* to values respectively indicated by arrows AR1, AR2, AR3 and AR4. The arrows AR3 is as long as the arrow AR4, and the air pressure indicated by the arrow AR3 is equal to the air pressure indicated by the arrow AR4. The arrow AR1 is longer than the arrow AR2 and shorter than the arrows AR3/AR4. For this reason, the air pressure indicated by the arrow AR1 is lower than the air pressure indicated by the arrows AR3/AR4, and is higher than the air pressure indicated by the arrow AR2. As a result, the inter-level insulating layer 15 is non-uniformly pressed against the polishing pad 24, and the inter-level insulating layer 15 is finished to be contact in thickness.

Figure 7:
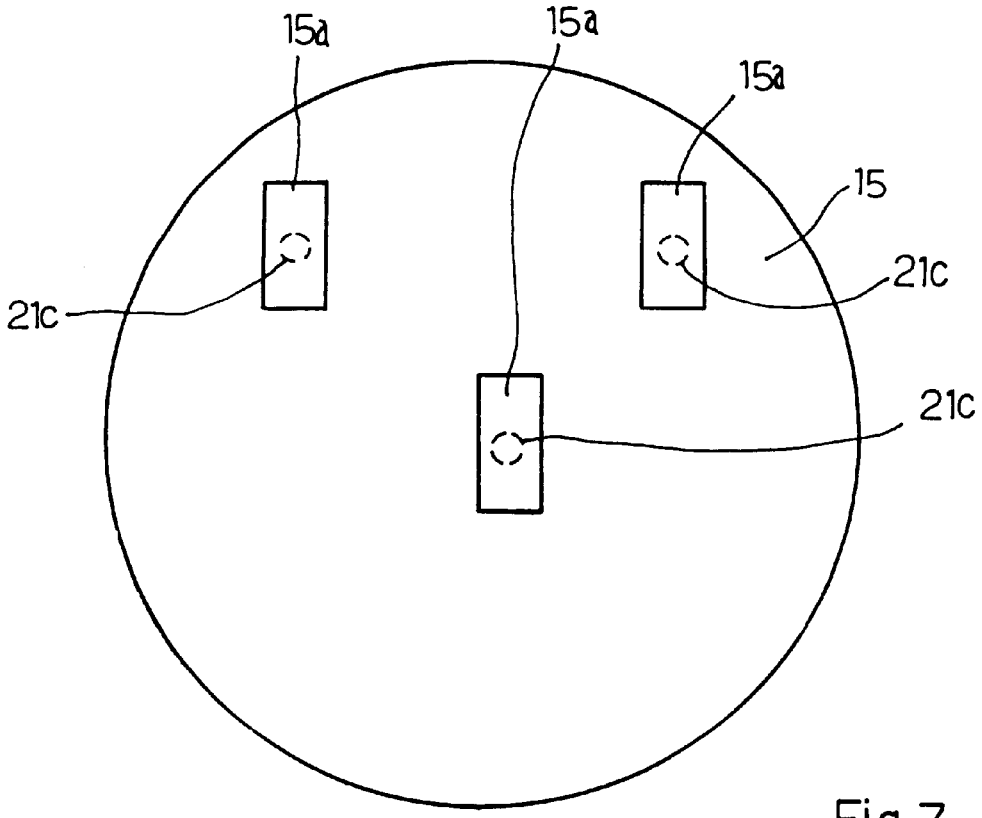
FIG. 7 schematically shows a matrix of measuring electrodes for detecting the thickness of the insulating layer at a plurality of areas.

If the inter-level insulating layer 15 has thick portions 15*a* (see FIG. 7), the matrix of the measuring electrodes 33 can detect the thick portions 15*a*, and the controller 35 instructs the high-pressure air source 23 to strongly presses the thick portions 15*a* against the polishing pad 24. As a result, the polishing system finishes the inter-level insulating layer 15 to have a uniform thickness.

As will be appreciated from the foregoing description, the measuring apparatus changes the relative position of the measuring electrode 33 with respect to the electrode 14, and determines the thickness of the inter-level insulating layer 15 at the relative position. Moreover, the electrode 14 is formed in the dicing area 11, and the electric field between the electrode 14 and the measuring electrode 33 does not damage a circuit component fabricated in the device area 13.

Although a particular embodiment of the present invention has been shown and described, it will be apparent to those skilled in the art that various changes and modifications may be made without departing from the spirit and scope of the present invention.

For example, if a single measuring electrode changes relative position to the electrode 14, the controller 35 can determine the thickness of different points on the semiconductor wafer. Therefore, the plural measuring electrodes 33 do not directly relate to the gist of the present invention.

What is claimed is:

1. An apparatus for measuring a thickness of an insulating layer on a semiconductor wafer, having a first surface held in contact with a non-conductive liquid spread over a moving member, comprising:

a second electrode means stationary with respect to said moving member, changing a relative position with respect to said first electrode means and a first distance to said first electrode means together with said moving member, and forming a first capacitor together with first electrode means, said insulating layer and said non-conductive liquid;

a third electrode means stationary with respect to said insulating layer and with respect to said first electrode means;

a fourth electrode means stationary with respect to said moving member, changing a second distance to said third electrode means and forming a second capacitor together with said third electrode means and said non-conductive liquid;

a source of electric power connected between said first and third electrode means and said second and fourth electrode means;

a measuring equipment connected to said second electrode and said fourth electrode for measuring a first capacitance between said first electrode means and said second electrode means and a second capacitance between said third electrode means and said fourth electrode means; and a calculating means connected to said measuring equipment for determining a thickness of said insulating layer on the basis of said first capacitance and said second capacitance; said first electrode means being formed on a major surface of said semiconductor wafer, and said second surface being polished.

2. The apparatus as set forth in claim 1, in which said semiconductor wafer is held by a wafer retainer, and said third electrode means is attached to said wafer retainer so that said second distance is varied together with said first distance during the polishing.

3. The apparatus as set forth in claim 2, in which said polishing pad and said wafer retainer are driven for rotation around a first axis and a second axis offset from said first axis, respectively, so that said first electrode means and said third electrode means are intermittently opposed to said second electrode means and said fourth electrode means, respectively.

4. The apparatus as set forth in claim 3, further comprising a first angle measuring equipment attached to said first axis for measuring a first angular position of said semiconductor wafer, a second angle measuring equipment attached to said second axis for measuring a second angular position of said polishing pad, and a controlling means giving a timing for determining said thickness of said insulating layer to said calculating means on the basis of said first and second angular positions.

5. The apparatus as set forth in claim 2, in which said calculating means eliminates an influence of said second capacitor from said capacitance of said first capacitor.

6. The apparatus as set forth in claim 1, in which said moving member and said non-conductive liquid serve as a polishing pad and polishing slurry between said second surface and said polishing pad.

7. The apparatus as set forth in claim 1, in which said semiconductor wafer has a plurality of device areas for fabricating circuit components and a dicing area for breaking said semiconductor wafer into semiconductor chips, and said first electrode means is formed in said dicing area.

8. An apparatus for measuring a thickness of an insulating layer having a first surface held in contact with a first electrode means and a second surface opposite to said first surface and held in contact with a non-conductive liquid spread over a moving member, said second surface being polished, said apparatus comprising:

a second electrode means stationary with respect to said moving member, changing a relative position with respect to said first electrode means and a first distance to said first electrode means together with said moving member, and forming a first capacitor together with first electrode means, said insulating layer and said non-conductive liquid;

a third electrode means stationary with respect to said insulating layer and with respect to said first electrode means;

a fourth electrode means stationary with respect to said moving member, changing a second distance to said third electrode means and forming a second capacitor together with said third electrode means and said non-conductive liquid;

a source of electric Power connected between said first and third electrode means and said second and fourth electrode means;

a measuring equipment connected to said second electrode and said fourth electrode for continuously measuring a first capacitance between said first electrode means and said second electrode means and a second capacitance between said third electrode means and said fourth electrode means while said insulating layer is being relatively moved with respect to said moving member, said second electrode means having a plurality of electrodes isolated from one another and selectively connected to said measuring equipment, said plurality of electrodes being opposed to said first electrode means and formed on a major surface of a semiconductor wafer; and a calculating means connected to said measuring equipment for determining a thickness of said insulating layer on the basis of said first capacitance and said second capacitance.

9. The apparatus as set forth in claim 8, in which said semiconductor wafer has a plurality of device areas for fabricating circuit components and a dicing area for breaking said semiconductor wafer into semiconductor chips, and said first electrode means is formed in said dicing area.

10. The apparatus as set forth in claim 9, in which said dicing area is formed into a lattice surrounding said plurality of device areas, and said first electrode means has a lattice configuration.

11. The apparatus as set forth in claim 10, in which said semiconductor wafer is held by a wafer retainer, and said third electrode means is attached to said wafer retainer so that said second distance is varied together with said first distance during the polishing.

12. The apparatus as set forth in claim 11, in which said moving member and said non-conductive liquid serve as a polishing pad and polishing slurry between said second surface and said polishing pad.

13. The apparatus as set forth in claim 12, in which said polishing pad and said wafer retainer are driven for rotation around a first axis and a second axis offset from said first axis, respectively, so that said first electrode means and said third electrode means are intermittently opposed to said second electrode means and said fourth electrode means, respectively.

14. The apparatus as set forth in claim 13, further comprising a first angle measuring equipment attached to said first axis for measuring a first angular position of said semiconductor wafer, a second angle measuring equipment attached to said second axis for measuring a second angular position of said polishing pad, and a controlling means giving a timing for determining said thickness of said insulating layer to said calculating means on the basis of said first and second angular positions.

15. The apparatus as set forth in claim 14, in which said calculating means eliminates an influence of said second capacitor from said capacitance of said first capacitor.

16. A polishing system for polishing an insulating layer formed on a semiconductor wafer, said system comprising:

measuring means for continuously measuring a thickness of more than one portion of said insulating layer responsive to variations of capacitance coupled to said semiconductor wafer during a polishing on said insulating layer;

a polishing Dad for polishing a surface of said insulating layer;

feeding means for supplying a non-conductive polishing slurry between said polishing pad and said surface of said insulating layer;

pressurizing means exerting a variable force on a plurality of portions of said semiconductor wafer for pressing said insulating layer against said polishing pad;

control means connected to said measuring means and said pressurizing means for instructing said pressurizing means to vary said variable force at said plurality of portions depending upon the thickness of said more than one portion of said insulating layer, said measuring means including:

a first electrode means formed between said semiconductor wafer and said insulating layer, a second electrode means attached to said polishing pad, changing a relative position with respect to said first electrode means and a first distance to said first electrode means while said surface of said insulating layer is being polished, said second electrode forming a first capacitor together with first electrode means, and together with said insulating layer and said polishing slurry, a third electrode means stationary with respect to said insulating layer and with respect to said first electrode means, a fourth electrode means attached to said polishing pad, changing a second distance to said third electrode means and forming a second capacitor together with said third electrode means and said non-conductive polishing slurry, a source of electric power connected between said first and third electrode means and said second and fourth electrode means;

a measuring equipment connected to said second electrode and said fourth electrode for measuring a first capacitance between said first electrode means and said second electrode means and a second capacitance between said third electrode means and said fourth electrode means, said second electrode means having a plurality of electrodes isolated from one another and selectively connected to said measuring equipment, said plurality of electrodes being opposed to said first electrode means formed on a major surface of said semiconductor wafer, and a calculating means connected to said measuring equipment for determining said thickness of said more than one portion on the basis of said first capacitance and said second capacitance.

17. The polishing system as set forth in claim 16, in which said semiconductor wafer has a plurality of device areas for fabricating circuit components and a dicing area for breaking said semiconductor wafer into semiconductor chips, and said first electrode means is formed in said dicing area.

18. The polishing system as set forth in claim 17, in which said dicing area is formed into a lattice surrounding said plurality of device areas, and said first electrode means has a lattice configuration.

19. The polishing system as set forth in claim 18, further comprising a wafer retainer for holding said semiconductor wafer, and said third electrode means is attached to said wafer retainer so that said second distance is varied together with said first distance during the polishing.

20. The polishing system as set forth in claim 19, in which said polishing pad and said wafer retainer are driven for rotation around a first axis and a second axis offset from said first axis, respectively, so that said first electrode means and said third electrode means are intermittently opposed to said plurality of electrodes and said fourth electrode means, respectively.

21. The polishing system as set forth in claim 20, in which said measuring apparatus further includes a first angle measuring equipment attached to said first axis for measuring a first angular position of said semiconductor wafer, a second angle measuring equipment attached to said second axis for measuring a second angular position of said polishing pad, and a controller giving a timing for determining said thickness of said more than one portion to said calculating means on the basis of said first and second angular positions.

22. The polishing system as set forth in claim 21, in which said calculating means eliminates an influence of said second capacitor from said capacitance of said first capacitor.

23. The polishing system as set forth in claim 19, in which a plurality of through-holes are formed in said wafer retainer, and said pressurizing means includes a high pressure gas source and a plurality of gas conduits respectively connected to said plurality of through-holes.

* * * * *